US005189273A

United States Patent [19]

Inukai et al.

[11] Patent Number: 5,189,273

[45] Date of Patent: Feb. 23, 1993

[54] MICROWAVE ABSORBING HEATER

[75] Inventors: Takao Inukai; Kanichi Tachibana; Kazuo Tsukada; Toshitaka Fujikawa; Keiichi Iida; Noboru Kogure, all of Tokyo, Japan

[73] Assignee: Mitsubishi Materials Corporation, Tokyo, Japan

[21] Appl. No.: 767,882

[22] Filed: Sep. 30, 1991

[30] Foreign Application Priority Data

Nov. 21, 1990 [JP] Japan ..... 2-314385
May 7, 1991 [JP] Japan ..... 3-101354

[51] Int. Cl.[5] ..... H05B 6/02

[52] U.S. Cl. ..... 219/10.55 E; 219/10.55 E; 428/241; 501/88; 501/92

[58] Field of Search ..... 219/10.55 F, 10.55 M, 219/10.55 E; 426/107, 234, 243; 428/241, 392, 649, 312.4, 316.6, 318.8; 501/88, 90–92, 95, 105

[56] References Cited

U.S. PATENT DOCUMENTS

| | | | |
|---|---|---|---|
| 3,941,967 | 3/1976 | Sumi et al. | 219/10.55 E |
| 4,543,345 | 9/1985 | Wei | 501/89 |
| 4,657,877 | 4/1987 | Becher et al. | 501/89 |
| 4,718,358 | 1/1988 | Nomi | 110/250 |
| 4,814,300 | 3/1989 | Helferich | 428/689 |
| 4,833,007 | 5/1989 | Huang | 428/242 |
| 4,946,808 | 8/1990 | Wei et al. | 501/95 |
| 4,962,000 | 10/1990 | Emslander et al. | 219/10.55 E |
| 4,977,302 | 12/1990 | Merigaud et al. | 219/10.55 E |
| 4,981,823 | 1/1991 | Crutchley et al. | 501/123 |
| 4,985,300 | 11/1991 | Huang | 428/392 |
| 5,001,088 | 3/1991 | Hauptmann et al. | 501/90 |
| 5,066,843 | 11/1991 | Revesz | 219/10.55 E |

FOREIGN PATENT DOCUMENTS

| | | |
|---|---|---|
| 0432794 | 6/1991 | European Pat. Off. . |
| 3634661 | 4/1988 | Fed. Rep. of Germany . |
| 4021033 | 1/1992 | Fed. Rep. of Germany . |
| 57-187035 | 11/1982 | Japan . |
| 58-008928 | 1/1983 | Japan . |
| 60-260197 | 12/1985 | Japan . |
| 1-095227 | 4/1989 | Japan . |
| 2-223730 | 9/1990 | Japan . |
| 3-067489 | 3/1991 | Japan . |

*Primary Examiner*—Bruce A. Reynolds
*Assistant Examiner*—Tuan Vinh To
*Attorney, Agent, or Firm*—Kanesaka and Takeuchi

[57] ABSTRACT

A microwave absorbing heater comprising a porous body containing silicon oxide and having a porosity of 40 to 95%.

A microwave absorbing heater may be formed of a porous body having a porosity of 40 to 95% and composed of an inorganic electrical insulating material, and a silicon carbide film formed on the surface thereof.

Since the microwave absorptivity is high, the dissipation of water from a heated object is easy and the heat dissipation is small, the heating efficiency is great. The thermal shock resistance is also high.

9 Claims, No Drawings

MICROWAVE ABSORBING HEATER

FIELD OF INVENTION AND RELATED ART STATEMENT

The present invention relates to a microwave absorbing heater which evolves heat by absorbing microwave. Particularly, it relates to the heater which is excellent in the heat shock resistance and evolving characteristic. More particularly, it relates to the heater which facilitates the diffusion of the vapor generated from the surface of a cooking material by heating and the scorching of the surface of the cooking material.

By utilizing the phenomenon that a material is heated by absorbing a microwave, lumbers, cloths, plastics, etc. are dried and processed. Such materials are dried and processed mainly by utilizing the dielectric heating of the dipoles existent in the materials which are rocked by an alternating electric field produced by the microwave and are heated by the friction between molecules.

Most of such microwave heating is based on the heat evolution of water molecules which are existent in the heated object and have dipole moment. Therefore, microwave heating is generally used for heating or drying a material containing water.

However, it is impossible to heat an object by water molecules to a temperature of higher than 100° C. due to the latent heat of vaporization, and when the water existing in the heated object is vaporized, since the water as a heating source is lost, the heating operation becomes gradual and the temperature of the heated object does not rise. In other words, it is impossible to heat an object to a temperature higher than 100° C. merely by irradiating the object containing water with a microwave. Therefore, an object is conventionally heated to a high temperature by using a dielectric or a magnetic material which absorbs a microwave and evolves heat as a heater and bringing the object into contact with the heater or utilizing the radiant heat of the heater.

As the heater, porcelains having heat resistance such as lead titanate porcelains, ferrite porcelains, soda-lime glass or the like is conventionally used.

Such conventional heaters, however, have problems in practical use. For example, they are poor in shock resistance, they are apt to produce a cracking by spattering of water during heating or the like, and since the vapor produced from the surface of a cooking material remains on the surface thereof, it is difficult to scorch the surface.

Although use of silicon carbide, which has an excellent shock resistance in spite of a poor dielectric heating as compared with ferrite or the like has been investigated, since silicon carbide is difficult to mold or form, they suffer from various problems in producing a practical product. In addition, since the microwave absorptivity is not so excellent, the retention of water on the surface of a cooking material is a serious problem, and the improvement of a heating characteristic is demanded.

OBJECT AND SUMMARY OF THE INVENTION

Accordingly, it is an object of the present invention to provide a microwave absorbing heater which absorbs a microwave with good efficiency, easily diffuses the water content on the surface of a cooking material so as to easily scorch the surface of the cooking material.

It is another object of the present invention to provide a microwave absorbing heater which has an improved molding and forming processability, which has sufficient resistance to the thermal shock caused by spattering of water or the like and which is hardly to be broken in ordinary handling.

To achieve these aims, a microwave absorbing heater provided in a first aspect of the present invention comprises a porous body containing silicon carbide and having a porosity of 40 to 95%.

Since the microwave absorbing heater of the present invention uses silicon carbide and it is a porous body having a large porosity, it prevents the vapor produced on the surface of a cooking material from remaining on the surface and it is excellent in thermal shock resistance. In addition, since the heat capacity is small, the microwave absorbing efficiency is high and the heat dissipation is small, the heating efficiency is prominently great.

According to the present invention, since the heater itself is a porous body, the shock resistance is much superior to that of a heater made of a dense sintered body, and it is possible to provide a microwave absorbing heater having a thermal shock resistance ($\Delta T$) of not less than 400° C. It is therefore possible to use a microwave absorbing heater safely for various uses without being broken.

In the microwave absorbing heater of the present invention, if the porosity of a porous body is less than 40%, the water produced on the surface of a cooking material remains on the surface, so that it takes a long time to scorch the surface and, in the worst case, the surface becomes soppy as the surface of boiled food. On the other hand, if the porosity exceeds 95%, the mechanical strength is insufficient for practical use.

A method of producing the microwave absorbing heater of the present invention will now be explained.

The microwave absorbing heater is produced by the following method (1) or (2), for example.

(1) After forming a layer containing silicon carbide on the surface of a porous body (porous body having continuous pores) made of a material which can be removed by dissolution or combustion, or after filling the pores of the porous body with a material containing silicon carbide, the material constituting the porous body is dissolved or burned for removal thereof.

(2) After mixing a powder containing silicon carbide with a material which can be removed by dissolution or combustion and forming a body, the body is sintered under pressurization. Simultaneously, the material which can be removed by combustion is removed. Alternatively, after sintering the porous body, the material which can be removed by dissolution is removed.

In the methods (1), (2), an organic combustible material such as carbon will be cited as an example of a material which can be removed by combustion. As an example of a material which can be removed by dissolution will be cited a metal which is dissolved in an acid such as nickel. A powder containing silicon carbide also includes a powder containing carbon and silicon which are reacted by heating them and produce silicon carbide.

In the method (1), CVD may be adopted for forming a silicon carbide layer. A method of immersing the porous body in a slurry containing silicon carbide or a material containing silicon carbide, namely, a slurry obtained by suspending an organic silicon compound which produces SiC by thermal decomposition such as polycarbosilane or general fine silicon carbide particles in water, drying the porous body and sintering it may also be adopted. It is also possible to directly fill the pores of the porous body with a silicon carbide powder.

The method (1) can be executed, for example, by depositing silicon carbide on the surface of porous carbon by CVD and thereafter removing carbon by heating and combustion.

In this case, CVD can be executed as follows. Methyltrichlorosilane as Si and C source is caused to flow as a material gas and SiC is deposited on the surface (the outer and inner surfaces and the inner walls of the pores) of a porous body which is maintained at a temperature of about 1,000° C.

A microwave absorbing heater of a second aspect of the present invention is characterized in that the porous body of the above first aspect is composed of silicon carbide.

A microwave absorbing heater of a third aspect is characterized in that the porous body of the first aspect is composed of 60–98 wt. % of silicon carbide and 40–2 wt. % of an inorganic electrical insulating material.

Especially, the microwave absorbing heater according to the third aspect, which contains a specified amount of inorganic electrical insulating material mixed to a porous body, is advantageous in that it is easy to consolidate silicon carbide particles without lowering the microwave absorptivity, thereby facilitating the manufacture of a porous body of silicon carbide.

In the microwave absorbing heater according to the third aspect, if the silicon carbide content is less than 60 wt. %, the microwave absorptivity and the heating efficiency are insufficient. On the other hand, if it exceeds 98 wt. %, the amount of the ingredients for consolidating silicon carbide powder or particles is small and the mechanical strength is insufficient for practical use. In the microwave absorbing heater of the third aspect, clay, feldspar, quarts, mullite, glass, cordierite, crystallized glass, frit, aluminum titanate and silicon nitride will be cited as examples of the inorganic electrical insulating material.

It is possible to produce the microwave absorbing heater of the third aspect by mixing coarse silicon carbide particles with clay, feldspar or the like and sintering the mixture so as to produce a porous body of silicon carbide in the form of what is called millet-and-rice cake, or by extruding a mixture of a fine silicon carbide powder and clay into a honeycomb porous body and sintering it, thereby producing a honeycomb porous body of silicon carbide.

A microwave absorbing heater of a forth aspect comprises a porous body having a porosity of 40 to 95% composed of an inorganic electrical insulating material and a silicon carbide layer formed on the surface thereof.

The microwave absorbing heater of the forth aspect, in which the porosity and the microwave absorptivity are allotted to an inorganic electrical insulating material and silicon carbide is advantageous in that it is easy to manufacture a porous body of silicon carbide having the above-described properties.

In the microwave absorbing heater of the forth aspect, at least one ceramic material selected from the group consisting of alumina, silica, mullite, cordierite, aluminum and silicon nitride will be cited as the inorganic electrical insulating material which constitutes a porous body. The thickness and the like of the silicon carbide film which is coated on the surface of the pores of the porous body composed of these materials is appropriately determined depending upon the purpose for which the microwave absorbing heater is used and the like. In ordinary cases, it is preferable that the silicon carbide content is determined so that the porosity of the porous body as the base is reduced to 10 to 20% by the formation of a silicon carbide film. In the present invention, the surface of a porous body includes not only the inner walls of the pores of the porous body but also the outer surface of the porous body itself.

The microwave absorbing heater of the forth aspect is produced by depositing silicon carbide on the surface of a porous body composed of a ceramic material such as alumina, silica and mullite by CVD, or immersing the porous body in a slurry of silicon carbide and thereafter sintering the porous body.

A microwave absorbing heater of a fifth aspect of the invention is characterized in that the porous body is reinforced with an inorganic electrical insulating fibers or whiskers.

The microwave absorbing heater of the fifth aspect facilitates the manufacture of the porous body and enhances the mechanical strength and the thermal shock resistance.

In the microwave absorbing heater of the fifth aspect, the electrical insulating ceramic fiber or whisker of at least one selected from the group consisting of alumina, silica, mullite, silicon carbide and silicon nitride is used as the inorganic fiber or whisker. By producing a felt-like or fibrous porous body from such a fiber or whisker, or mixing such a fiber or whisker with an inorganic electrical insulating powder, manufacture of a porous body from an inorganic electrical insulating material which is used in the manufacture of a conventional heater is facilitated and the mechanical strength of the heater is enhanced.

The microwave absorbing heater of the fifth aspect is produced by mixing a predetermined amount of the reinforcing inorganic fiber or whisker during the process of producing the porous body by the method (1) or (2).

In the present invention, it is preferable that a conductive material which can be existent in silicon carbide during the manufacturing process such as free carbon and free silicon is removed therefrom to as great an extent as possible. This is because free carbon and free silicon, which may remain as an unreacted product when silicon carbide is produced by a reaction, have a high conductivity, which may lead to a defect such as great deterioration of the heating efficiency.

Since the heater of the invention is composed of silicon carbide, it facilitates the diffusion of the vapor from a heated surface and removal of the water from the heated food, thereby enabling the surface of the cooking material to be quickly scorched. In addition, since the microwave absorbing efficiency is high, the heat capacity is small and the heat dissipation is small, the microwave absorbing heater efficiently evolves heat by the irradiation of a microwave and it has a high thermal shock resistance.

DESCRIPTION OF THE PREFERRED EMBODIMENTS

The present invention will be explained in more detail with reference to the following examples.

EXAMPLE 1

Porous bodies (Samples Nos. 1 to 6) of silicon carbide having the respective porosities shown in Table 1 were produced by the method A or B shown in Table 1. Each of the porous bodies of silicon carbide was irradiated with a microwave at an output of 500 W for 2 minutes and the temperature of the surface was measured. The presence or absence of a crack during and after heating (including the case in which water is spattered), and the state of cooked food such as meat and vegetable which was irradiated with the microwave for 2 minutes on the porous body of silicon carbide was observed.

The results are shown in Table 1.

TABLE 1

| No. | Porosity (%) | Method*1 adopted | Surface temperature (°C.) | Crack | State*2 of cooked food | Remark |
|---|---|---|---|---|---|---|
| 1 | 3 | A | 250 | None | a | Comparison |
| 2 | 35 | A | 240 | None | b | Comparison |
| 3 | 45 | A | 240 | None | c | Invention |
| 4 | 80 | B | 220 | None | d | Invention |
| 5 | 95 | B | 200 | None | d | Invention |
| 6 | 97 | B | — | Some | — | Comparison |

*1 Method

A: Small beads of polystyrene were mixed with a silicon carbide powder and after forming the mixture, it was sintered under pressurization to obtain a porous body of silicon carbide having a predetermined porosity.

B: Urethane foam was carbonized to produce porous carbon. Si and C source such as methyl trichlorosilane was supplied as a material gas to the porous carbon which was maintained at 1,000° C. to produce silicon carbide on the inner surface of the pores and the outer surface of the porous carbon. Thereafter, carbon was removed by combustion, thereby obtaining a porous body of silicon carbide having a predetermined porosity.

*2 State a: Water content remained on the surface of the cooked food. Soppy.

b: The cooked food adhered to the surface of the porous body and the surface of the cooked food was not scorched.

c: The surface of the cooked food was scorched.

d: The surface of the cooked food was scorched in a short time.

As is obvious from Table 1, the heaters 1 and 2 of the porous bodies having a low porosity such as 3% and 35%, vapor remained on the surface of the cooked food and the water content was not removed, so that the surface of the cooked food was not scorched. On the other hand, in the porous body having a porosity as high as 97%, the mechanical strength was low and crack was produced, so that practical use thereof was impossible. In contrast, the porous bodies having a porosity in the range defined by the present invention had a sufficient mechanical strength and the cooked food was scorched.

EXAMPLE 2

A silicon powder and a carbon powder were mixed in a mixing molar ratio of Si:C=2:1 and Si:C=1:2. Each of the mixed powders was formed under pressurization and baked at 1,400° C. in an inert atmosphere to produce SiC by the reaction of Si and C. In this way, a porous body (Sample No. 7) of silicon rich silicon carbide (Si—SiC) having a porosity of 45% and a porous body (Sample No. 8) of carbon rich silicon carbide (C—SiC) having a porosity of 50% were produced.

Each of the porous bodies was irradiated with a microwave at an output of 500 W for 2 minutes and the temperature of the surface was measured. The results are shown in Table 2.

The sample of No. 7 was immersed in a caustic soda solution to remove free silicon by dissolving the excess silicon (Sample No. 9).

The sample of No. 8 was heated in air to remove free carbon by oxidization of the excess carbon (Sample No. 10).

Each of Samples Nos. 9 and 10 was irradiated with a microwave at an output of 500 W for 2 minutes and the temperature of the surface was measured. The results are shown in Table 2.

Cooking material was placed on the surface of each of the porous bodies of silicon carbide and irradiated with the same microwave. The state of the surface of the cooked food which was in contact with the surface of the porous body was observed. The results are shown in Table 2.

TABLE 2

| No. | Type of porous body | Surface temperature (°C.) | State of cooked food | Remark |
|---|---|---|---|---|
| 7 | Si—SiC | 93 | Not scorched | Comparison |
| 8 | C—SiC | 95 | Not scorched | Comparison |
| 9 | SiC | 250 | Scorched | Invention |
| 10 | SiC | 350 | Scorched | Invention |

EXAMPLE 3

In the method A of Example 1, in place of silicon carbide powder, coarse silicon carbide particles having an average particle diameter of 1 mm were mixed with an inorganic electrically insulating material shown in Table 3 so that the ratio of the silicon carbide in the mixed powder is shown in Table 3, and a slight amount of organic binder and polystyrene beads as a pore forming material were added thereto. The resultant mixture was formed and baked at 1,100° C. to produce a porous body containing silicon carbide. The porous body had a porosity of 50% and it was in the form of what is called millet-and-rice cake. Each porous body was irradiated with a microwave at an output of 500 W for 2 minutes, and the presence or absence of a crack and the temperature of the surface were examined. The results are shown in Table 2.

TABLE 3

| No. | Inorganic electrically insulating material | Ratio of silicon carbide (wt %) | Crack | Surface temperature (°C.) | Remark |
|---|---|---|---|---|---|
| 11 | Clay + | 50 | None | 70 | Comparison |

TABLE 3-continued

| No. | Inorganic electrically insulating material | Ratio of silicon carbide (wt %) | Crack | Surface temperature (°C.) | Remark |
|---|---|---|---|---|---|
| | feldspar | | | | |
| 12 | Clay + feldspar | 60 | None | 130 | Invention |
| 13 | Clay + feldspar | 80 | None | 250 | Invention |
| 14 | Clay + feldspar | 90 | None | 350 | Invention |
| 15 | Clay + feldspar | 98 | None | 380 | Invention |
| 16 | Clay + feldspar | 99 | Some | 400 | Comparison |

It is clear from Table 3 that both the porous body containing less than 60 wt. % of silicon carbide and the porous body containing more than 98% of silicon carbide are unfavorable, because in the former, since the silicon carbide content is too small, the absorption of the microwave is insufficient and sufficient heating is impossible, while in the latter, the inorganic electrically insulating material is lacking, so that sufficient mechanical strength is not obtained.

EXAMPLE 4

In the method A of Example 1, in place of silicon carbide, a silicon carbide powder was mixed with the inorganic fiber shown in Table 4 so that the ratio of the silicon carbide in the mixed powder is shown in Table 4 to produce a porous body of silicon carbide reinforced by the fiber. The porous body had a porosity of 50%. Each porous body was irradiated with a microwave at an output of 500 W for 2 minutes. In order to examine the thermal shock resistance, the porous body was dropped into water immediately after each porous body was irradiated with a microwave for 3 minutes. This test was repeated until a crack was produced on the porous body and the number of times of repeat tests was counted. The results are shown in Table 4 in comparison with a porous body which contained no inorganic fiber.

TABLE 4

| No. | Inorganic fiber | Ratio of silicon carbide (wt %) | Surface temperature (°C.) | Thermal shock resistance (time) |
|---|---|---|---|---|
| 17 | Mullite | 70 | 150 | 11 |
| 18 | Mullite | 80 | 200 | 10 |
| 19 | Mullite | 90 | 250 | 8 |
| 20 | — | 100 | 280 | 2 |

It is obvious from Table 4 that the thermal shock resistance is greatly enhanced in a porous body of silicon carbide reinforced with a fiber.

EXAMPLE 5

A silicon carbide layer was formed by CVD on the surface of a porous body of mullite having a porosity of 80% by using dimethylchlorosilane to produce a porous body of mullite coated with silicon carbide having a porosity of 75%. When the porous body obtained was irradiated with a microwave at an output of 500 W for 2 minutes, the surface temperature was raised to 300° C.

EXAMPLE 6

After immersing a porous body of carbon having a porosity of 50% in a slurry with silicon carbide suspended therein and drying the porous body, it was sintered in an inert gas atmosphere, thereby producing a sintered body of silicon carbide with carbon dispersed therein. When the sintered body was irradiated with a microwave at an output of 500W for 2 minutes, the surface temperature was no more than 90° C.

The sintered body was then heated in air to remove free carbon by oxidization, thereby obtaining a porous body of silicon carbide having a porosity of 45%. When the porous body obtained was irradiated with a microwave at an output of 500 W for 2 minutes, the surface temperature was raised to as high as 380° C.

EXAMPLE 7

A silicon carbide layer was formed by CVD on the surface of porous nickel having a porosity of 80% by using methyltrichlorosilane to produce a porous body of nickel coated with silicon carbide. When the porous body obtained was irradiated with a microwave at an output of 500W for 2 minutes, the surface temperature was no more than 90° C.

The porous body was then immersed in hydrochloric acid to remove nickel by dissolution, thereby obtaining a porous body of silicon carbide. When the porous body obtained was similarly irradiated with a microwave, the surface temperature was raised to as high as 410° C.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A microwave absorbing heater comprising a porous body formed of silicon carbide without substantially having free carbon and free silicon and having a porosity of 40 to 95% so that the porous body does not substantially retain therein vapor produced from a material heated by the microwave and provides high thermal shock resistance not less than 400° C. to easily scorch a surface of the heated material.

2. A microwave absorbing heater comprising a porous body having a porosity of 40 to 95% so that the porous body does not substantially retain therein vapor produced from a material heated by the microwave and provides high thermal shock resistance not less than 400° C. to easily scorch a surface of the heated material, said porous body being composed of 60 to 98 wt. % of the silicon carbide without substantially having free carbon and free silicon and 40 to 2 wt. % of an inorganic electrical insulating material to consolidate the silicon carbide particles without lowering microwave absorption ability.

3. A microwave absorbing heater according to claim 2, wherein said porous body is reinforced with at least one of an inorganic electrical insulating fiber and a whisker.

4. A microwave absorbing heater according to claim 3, wherein said inorganic electrical insulating fiber and whisker are selected from the group consisting of alumina, silica, mullite, silicon carbide and silicon nitride.

5. A microwave absorbing heater according to claim 2, wherein said inorganic electrical insulating material is at least one selected from the group consisting of clay, feldspar, quarts, mullite, glass, cordierite, crystallized glass, frit, aluminum titanate and silicon nitride.

6. A microwave absorbing heater comprising a porous body having a porosity of 40 to 95% and composed of an inorganic electrical insulating material and a silicon carbide layer without substantially having free carbon and free silicon and formed on an entire surface of the porous body so that the porous body does not substantially retain therein vapor produced from a material heated by the microwave and provides high thermal shock resistance not less than 400° C. to easily scorch a surface of the heated material.

7. A microwave absorbing heater according to claim 6, wherein said porous body is reinforced with at least one of an inorganic electrical insulating fiber and a whisker.

8. A microwave absorbing heater according to claim 7, wherein said inorganic electrical insulating fiber and a whisker are selected from the group consisting of alumina, silica, mullite, silicon carbide and silicon nitride.

9. A microwave absorbing heater according to claim 6, wherein said inorganic electrical insulating material is at least one selected from the group consisting of clay, feldspar, quarts, mullite, glass, cordierite, crystallized glass, frit, aluminum titanate and silicon nitride.

* * * * *